United States Patent [19]

Patton

[11] 4,453,164

[45] Jun. 5, 1984

[54] METHOD OF DETERMINING EXCITATION OF INDIVIDUAL ELEMENTS OF A PHASE ARRAY ANTENNA FROM NEAR-FIELD DATA

[75] Inventor: Willard T. Patton, Moorestown, N.J.

[73] Assignee: RCA Corporation, New York, N.Y.

[21] Appl. No.: 401,514

[22] Filed: Jul. 26, 1982

[51] Int. Cl.[3] ..... H01Q 3/00

[52] U.S. Cl. ..... 343/360; 343/372

[58] Field of Search ..... 343/100 SA, 854, 100 AP, 343/703, 360, 369, 371, 372

[56] References Cited

U.S. PATENT DOCUMENTS

| | | |
|---|---|---|
| 3,378,846 | 4/1968 | Lowenschuss . |
| 3,732,569 | 5/1973 | Collins . |
| 3,879,733 | 4/1975 | Hansen et al. . |
| 4,201,987 | 5/1980 | Tricoles et al. . |
| 4,270,129 | 5/1981 | Herper et al. . |

OTHER PUBLICATIONS

"Implementing a Near-Field Antenna Test Facility", by W. A. Harmening, *Microwave Journal,* Sep. 1979, pp. 44–55.

"Automating Near-Field Antenna Testing for Phased Array Radars", by D. Staiman, *IEEE International Radar Conference,* 1980, pp. 248–252.

"Precision in Large Mechanisms–The Near-Field-Antenna Test Scanner", by W. A. Harmening, *RCA Engineer,* Jan./Feb. 1981, pp. 46–51.

"Planar Near-Field Measurements on High Performance Array Antennas", by A. C. Newell, et al., 1974, *National Bureau of Standards,* Boulder, Colorado.

"Plane-Wave Scattering-Matrix Theory of Antennas and Antenna-Antenna Interactions", by D. M. Kerns, 1981, *National Bureau of Standards,* Boulder, Colorado.

"Antenna Analysis by Near-Field Measurements", by K. R. Grimm, *Microwave Journal,* Apr. 1976, pp. 43–52.

"A Method of Locating Defective Elements in Large Phased Arrays", by P. L. Ransom and R. Mittra, in *Phased Array Antennas,* Artech House, 1973, pp. 351–356.

"Phased Array Alignment with Planar Near-Field Scanning or Determining Element Excitation from Planar Near-Field Data", by W. T. Patton in *Proceedings of the 1981 Antenna Applications Symposium,* Sep. 23, 24, 25, 1981, University of Illinois.

*Primary Examiner*—Theodore M. Blum

*Attorney, Agent, or Firm*—Joseph S. Tripoli; Robert L. Troike; Robert Ochis

[57] ABSTRACT

A near-field data measurement technique which provides sufficient data to enable the resolution of array element characteristics which are localized within a circle having a radius less than 0.61λ is disclosed. This allows phase correction of individual array elements having spacings substantially less than 0.61λ during the alignment of a phase array in a near-field test system.

10 Claims, 14 Drawing Figures

METHOD OF DETERMINING EXCITATION OF INDIVIDUAL ELEMENTS OF A PHASE ARRAY ANTENNA FROM NEAR-FIELD DATA

This invention relates to phased array antennas and more particularly to alignment of phased array antennas.

Use of near-field data for phased array antenna alignment has become an accepted technique which allows a phased array antenna to be aligned much more rapidly than can be done using measured far-field data. For far-field measurement, the antenna itself must be physically scanned in a manner to place each of the far field points of the array pattern which must be measured during alignment at the location of a fixed far-field probe. In addition, part of the alignment is normally done by measuring subassemblies of the antenna and adjusting them prior to far-field testing. These preadjustments are not changed during the far-field testing.

The near-field testing technique and some of its advantages over far-field testing are described in the literature including "Planar Near-Field Measurements on High Performance Array Antennas" by A. C. Newell, et al. 1974, *National Bureau of Standards,* Boulder, Colo.; "Plane-Wave Scattering-Matrix Theory of Antennas and Antenna-Antenna Interactions", by D. M. Kerns, 1981, *National Bureau of Standards,* Boulder, Colo.; "Antenna Analysis by Near-Field Measurements" by K. R. Grimm, *Microwave Journal,* Apr. 1976, pp 43–52; "Implementing a Near-Field Antenna Test Facility" by W. A. Harmening, *Microwave Journal,* Sept. 1979, pp 44–55; "Automating Near-Field Antenna Testing For Phased Array Radars" by D. Staiman, *IEEE International Radar Conference,* 1980, pp. 248–252; and "Precision in large mechanisms—the near-field-antenna test scanner" by W. A. Harmening, *RCA Engineer,* Jan./Feb. 1981, pp. 46–51. Each of these references is incorporated herein by reference.

As is explained in more detail in the references noted above, the near-field data alignment technique involves measuring field data (amplitude and phase) for points on a planar rectangular grid positioned in front of the array within the near field. The distance between the array face and the measurement plane is normally on the order of 25 centimeters for antennas designed to operate in the 3 to 4 GHz frequency range. The number of points for which data is taken depends on the size of the array being aligned, the degree of alignment accuracy required and the separation distance. With a separation of 25 centimeters between the antenna aperture and the measurement grid, and an array having about 4,400 elements, the number of data points needed for alignment can be as many as 262,144 (a 512 by 512 point grid) or more for alignment at a single frequency. However, these measurements can be taken rapidly because the entire near-field test is done with the array in one fixed position and with a field probe (source or sensor) which can be rapidly scanned along the measurement grid.

Alignment using the near-field data technique involves the computation of two Fourier transforms. A first of these transforms is used to transform the near-field data which is spacial in nature to an equivalent far field frequency domain. This far-field frequency domain data is known in the art as the plane wave spectrum of the antenna. That antenna spectrum is divided by the average spectrum of an antenna element to provide an array spectrum. The phase of this array spectrum is corrected by a phase proportional to the separation between the radiating aperture of the antenna and the near-field data measurement plane to shift the point of phase reference to the antenna aperture. An inverse transform is then performed on this modified array spectrum to obtain amplitude and phase data at the antenna aperture. This alignment technique has been quite satisfactory for phased array antennas composed of sub-arrays of uniformily excited elements or where individual array elements were widely spaced. Unfortunately, the near-field alignment technique has not been useable for aligning array antennas having individually excited elements which are spaced less than 0.61 wavelengths (0.61λ) center-to-center at the measurement frequency. The Fourier transform of the near-field data for an antenna has zero amplitude (other than from noise and measurement errors) at and beyond a circle having a radius in transform space corresponding to the wave number of a wave of that frequency in a vacuum. The area within this circle is known as real or visible space and a transform of this circle to the antenna aperture corresponds to an element-to-element spacing of 0.61λ. The region inside that circle is referred to as real or visible space and the region outside that circle is referred to as imaginary or invisible space to distinguish between those areas (real or visible) where the data values are measurable or accessible and thus transform accurately back to the array aperture in a defined manner and those regions (imaginary or invisible space) where the data values are strongly attenuated and thus are not measurable and cannot be accurately transformed back to the array aperture. This is discussed on page 250 of the Staiman article. If the antenna element spacing is less than 0.61λ, the fundamental period of the antenna spectrum extends beyond the visible circle with the result that data which is necessary for antenna alignment is lost and an inverse transform does not provide phase and amplitude data with sufficient resolution to determine individual element excitations. A further explanation of this visible circle limitation may be found in the paper "A Method of Locating Defective Elements in Large Phased Arrays" by P. L. Ransom and R. Mittra, in *Phased Array Antennas,* Artech House, 1973, pp 351–356 with the most relevant material appearing at page 353. This article is incorporated herein by reference.

Near-field data for reception alignment of a phased array antenna is taken by mounting a point radiation source on a xy scanning mechanism for translation in the measurement plane in front of the array aperture. A receiver is connected to the beamformer whose alignment is to be determined by the near-field technique. The radiation source is then scanned along the measurement grid with the phase and amplitude of the signal reaching the receiver being recorded as the probe reaches each measurement point. Once data for all measurement points has been obtained, the data is processed to provide data on the phase and amplitude of radiating members of the array whose alignment is then adjusted in accordance with that data.

In some applications it is desirable that phased array antennas have very low side lobe levels (down 40 dB or more from the main beam). To achieve such low side lobe levels, the antenna elements must be individually excited (rather than in groups) with proper amplitude and phase. Proper alignment of such an antenna requires knowledge of the excitation (phase and amplitude) of each individual element. In such an array because of array size and scan requirements, it is desirable to have center-to-center element spacings which are substantially less than 0.61λ at the operating frequency of the antenna. As a result of this small inter-element spacing, the antenna spectrum in transform space extends into the region beyond visible space where the data is highly attenuated such that the data cannot be inverse transformed (due to excessive noise and measurement error contributions) and the data is termed inaccessible in accordance with the prior art.

An alignment technique is needed which is useful with phased array antennas having individually excited elements which are spaced less than 0.61λ center-to-center.

The present invention overcomes the element-to-element spacing limitations of the prior art near-field alignment techniques by taking near-field data with the beam steered in at least first and second off-broadside directions. The data taken for the first beam direction brings a first portion of the array spectrum within the visible circle in transform space and the data taken for the second beam direction brings a second, and different, portion of the array spectrum within the visible circle. In this manner separate portions of the array spectrum which together comprise the entire fundamental period of the spectrum required for antenna alignment are brought within the visible circle at different times. A composite array spectrum is assembled from the data taken with the beam steered in the different directions. This composite spectrum is obtained entirely from non-attenuated data and can therefore be inverse transformed in a manner to provide sufficient resolution to allow the determination of individual element excitations even when the elements are spaced more closely than 0.61λ.

Figure 4:
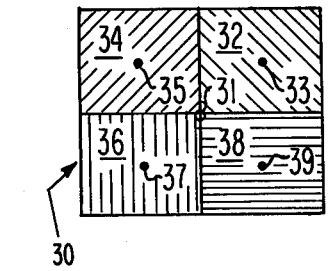
FIG. 4 illustrates the fundamental period of the antenna spectrum in FIG. 3 divided into four quadrants.
Figure 6B:
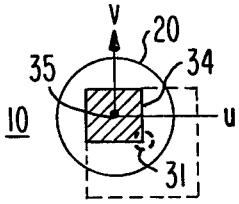
Figure 6A:
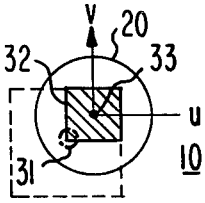
Figure 6C:
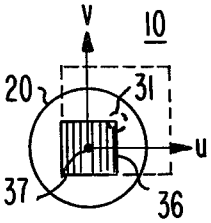
Figure 6D:
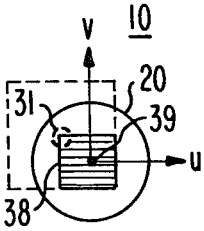
Figure 7A:
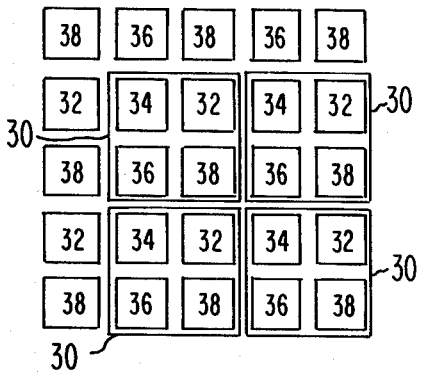
Figure 7B:
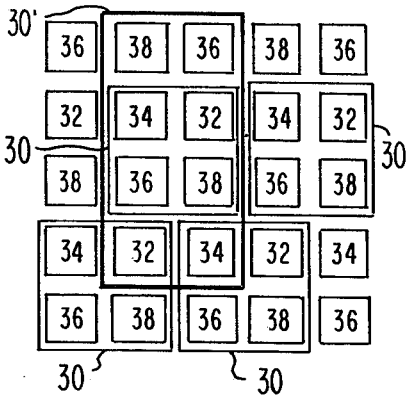
Figure 8:
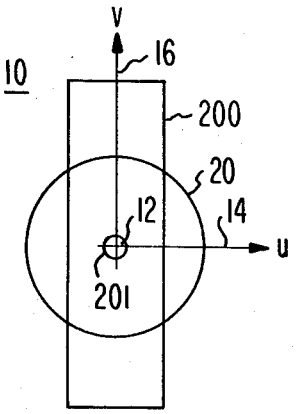
Figure 9:
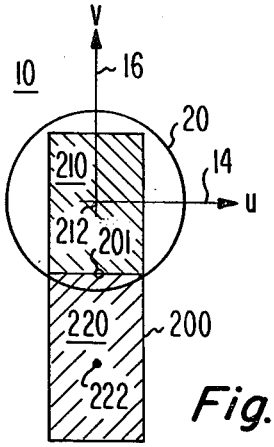
Figure 10:
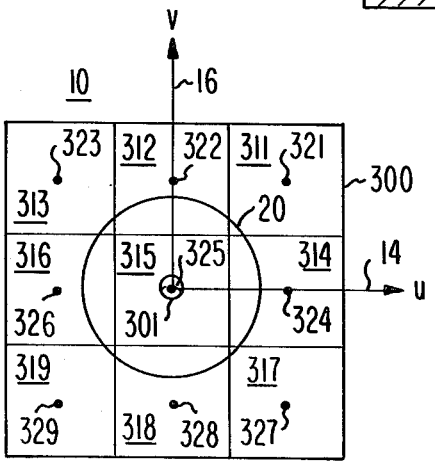

FIGS. 6*a*–6*d* illustrate a manner of centering each of the quadrants of the fundamental period of the antenna spectrum of FIG. 4 within visible space by steering the beam off-broadside in selected direction;

FIGS. 7A and 7B illustrate the sets of far-field data which need to be inverse transformed in order to obtain data points in alignment with the antenna elements;

FIGS. 8 and 9 illustrate an antenna spectrum for which one half at a time can be brought within visible space; and FIG. 10 illustrates an antenna spectrum which must be divided into nine sections and each one brought separately into visible space if its array is to be aligned using this technique.

Figure 1:
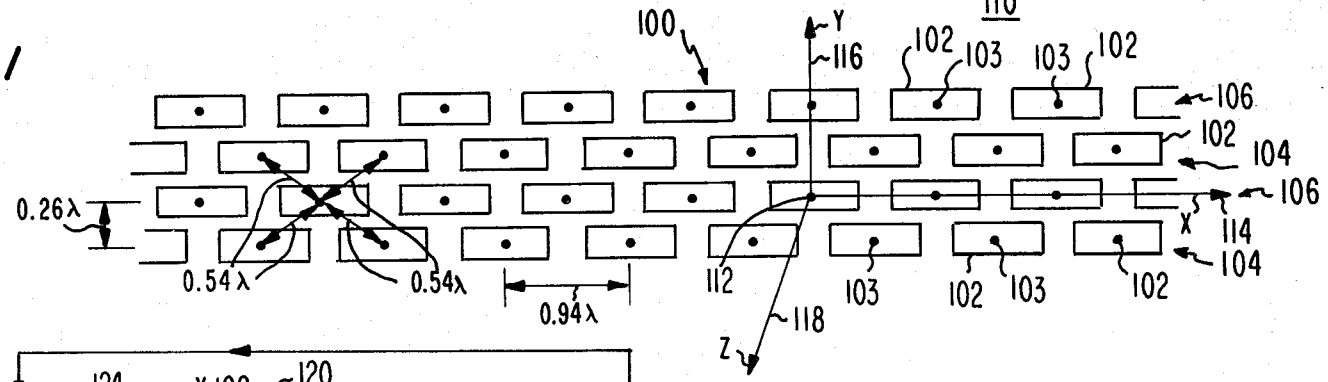
FIG. 1 illustrates an array antenna element pattern having a triangular grid and element center-to-center spacing of less than 0.61λ.

A portion of an array antenna 100 having individual rectangular antenna elements 102 having centers 103 is illustrated in FIG. 1 in physical space 110 which has an xyz coordinate system having an origin 112, an x axis 114, a y axis 116 and a z axis 118. The origin 112 is shown coinciding with the center 103 of one of the elements 102, but this is not necessary. The elements are arranged in alternating rows 104 and 106 which extend parallel to the x axis 114. The elements 102 have their long dimension oriented parallel to the x axis and thus to the length of the rows. The elements in rows 106 are displaced along the row half a period from the elements in rows 104 to provide a triangular element grid. Spacing along the rows is 9.144 centimeters center-to-center and the center-to-center spacing of the rows is 2.5146 centimeters. At a frequency within the designed operating frequency band, the elements within a given row are spaced 0.94λ center-to-center and adjacent rows are spaced 0.26λ from each other. This produces a center-to-center spacing between an element and its four nearest neighbors at that frequency of approximately 0.54λ which is a diagonal distance from that element to any one of the two adjacent elements in the row just above it and the two adjacent elements in a row just below it.

Figure 2:
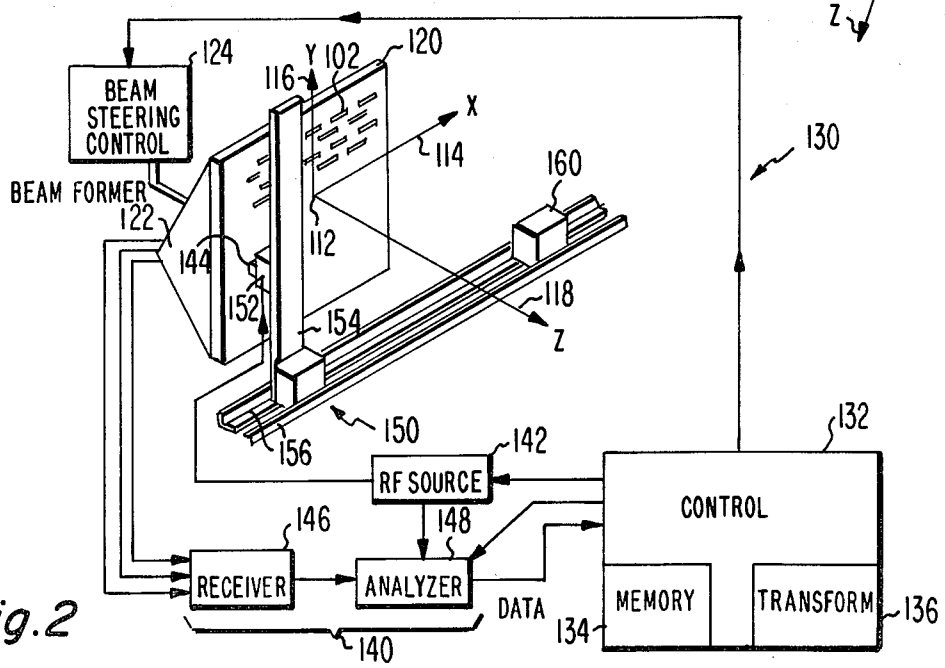
FIG. 2 illustrates a phased array antenna in position in a near-field test system for taking near-field data.

In FIG. 2, an array antenna 120 having the element pattern 100, a beamformer 122 and a beam steering controller 124, is shown in position for near-field testing in a near-field test system 130. Near-field test system 130 includes a system control 132 which preferably includes a computer, a data memory 134, a transform unit 136, an RF measurement system 140, a scanning mechanism 150 and a position measuring system 160.

The RF measurement system 140 includes an RF frequency source 142, a field probe 144 coupled to receive signals from source 142, a receiver 146 connected to receive signals from the beamformer 122 of the antenna 120, and an analyzer 148 coupled to receive signals from source 142 and receiver 146. Analyzer 148 provides output signals representative of the phase and amplitude of the signal from receiver 146 relative to the signal from RF source 142.

The scanning system 150 includes a carriage 152 which is mounted on and travels vertically along a tower 154 which is mounted on a set of horizontal rails 156. The RF probe 144 is mounted on a carriage 152 in order that the probe 144 may be scanned throughout the measurement plane. Vertical probe motion is obtained by vertical carriage motion along the tower 154 while that tower is held fixed on the horizontal rails. Horizontal motion is obtained by moving the tower 154 horizontally on the rails 156. The probe 144 may take any appropriate form and, as indicated in the Staiman article at page 249, may preferably be a low height open-ended waveguide. The position measuring system 160 is preferably a laser interferometer system which includes fixed components, components mounted on the tower and components mounted on the carriage and has the purpose of accurately determining the position (x,y,z) of the probe as it is scanned and measurements are taken.

The control 132, controls the beam steering control 124 of the antenna 120 for controlling the phase settings of the phase shifters of the antenna 120.

This near-field measurement system to the extent described so far is in accordance with known near-field measurement systems (such as those described in the above-cited references) in that it performs the functions of scanning the probe in front of the antenna, exciting the antenna with RF energy and measuring the amplitude and phase of the received signal at a plurality of measurement points.

In accordance with the present invention, the accuracy of these various systems may be improved in accordance with the desired degree of the alignment of the antenna through the use of the techniques described herein. In addition, control 132 during the taking of the data for alignment purposes, controls the beam steering control 124 of the antenna to steer the antenna beam in at least two off-broadside directions while the data (in the near-field) for antenna alignment is being taken. This is a departure from previous near-field techniques in which the antenna was aligned with the beam steered to broadside.

Using the near-field test system 130 to measure the near-field pattern of the antenna 120 in a particular beam steering direction is accomplished by control 132 providing a command to the beam steering control 124 for the antenna to set the phase shifters of the antenna to the desired beam steering angle. The scanning tower 154 is positioned at an extreme end of the measurement plane and the carriage 152 is positioned at the bottom of the tower. The RF measurement system 140 and the position measurement system 160 are activated and the probe is scanned vertically by motion of the carriage 152. As the carriage scans, data is recorded from the analyzer 148 when the probe reaches each of the grid points at which data is desired. These grid points for array 120 are centered on the element rows and spaced 2.5146 centimeters vertically. Once the carriage reaches the top of its scan range, it returns to the bottom of the tower and the tower is indexed horizontally by a distance equal to the horizontal spacing between grid points. Horizontal grid points for array 120 are spaced 2.286 centimeters horizontally and include points centered in front of each element as well as additional points. The process is then repeated for the next vertical column of grid points until the entire grid has been scanned. It is preferred to store data temporarily in control 132 during each vertical scan of the carriage 152 and then transfer it to mass memory 134 for longer term storage during the return of the carriage and probe to the bottom of the tower.

It is preferred with a larger array (several thousand elements) to have a measurement grid which is 512 grid points vertically by 512 grid points horizontally.

At each grid point, the RF amplitude and phase of the receiver signal relative to the source signal is recorded in memory along with the actual position of the probe 144 as determined by the position measurement system 160. Once the entire measurement grid (512×512) has been scanned, the measured RF data at each grid point may be corrected for any measured position error of the probe from that grid point at the time that data was taken. This may be done by adjusting the phase of the measured data at a grid point by the phase at the measurement frequency corresponding to the displacement of the measurement point from the grid point in a direction parallel to that in which the beam is steered. Following any desired corrections to the data, the data is transformed to the far field. This is preferably done using the near-field antenna test software developed by the National Bureau of Standards in Boulder, Colo.

In actual practice, where an antenna 120 is to be aligned at a number of frequencies, data may be taken at a number of frequencies during a single scan by switching the RF source frequency and the phase shifter settings as the probe scans vertically with the result that a vertically interleaved set of grids results in which each successive grid is at a different frequency and the spacing of points within any single frequency grid is in accordance with the desired spacing for data accuracy. This, however, is a measurement convenience enabling an antenna to be aligned more rapidly than otherwise and not a fundamental change in the system.

Figure 3:
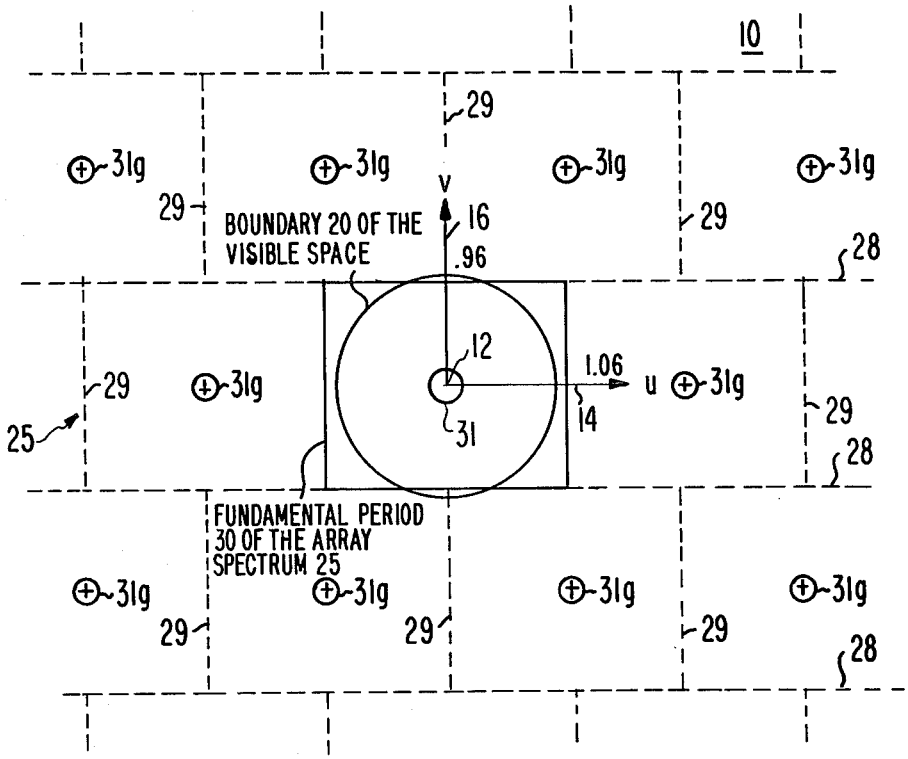
FIG. 3 illustrates the periodicity of the antenna spectrum of FIG. 1 in transform space and its fundamental period and that fundamental period's relation to the boundary of visible space for a broadside beam.

A portion of an antenna spectrum 25 in transform space 10 for the element pattern of antenna 100 is illustrated in FIG. 3. Transform space 10 has a uv coordinate system which has an origin 12, a u axis 14 and a v axis 16. This spectrum includes a main beam or lobe having its center at the center of a circle 31 and a plurality of grating lobes having their centers at the centers of circles 31*g*. The circle 31 is used to define the location of the main lobe to prevent confusion with the origin 12. The circles 31*g* are used to define the locations of the grating lobes for consistency. The spectrum 25 is periodic and dashed lines 28 and 29 mark the transitions between successive periods of the spectrum 25. Successive rows of this periodic spectrum are off-set half a period with respect to the adjacent rows (that is, stacked like bricks in a wall rather than like the squares in a checkerboard) because of the triangular brick-like grid in which the elements 102 of the array 120 are positioned.

The fundamental period 30 is larger than visible space and extends beyond the boundary 20 of visible space. Thus, the prior art requirement that the entire fundamental period of the antenna spectrum be within visible space is violated and it is not possible to use the prior art techniques to determine the individual element excitations (phase and amplitude).

Figure 5:
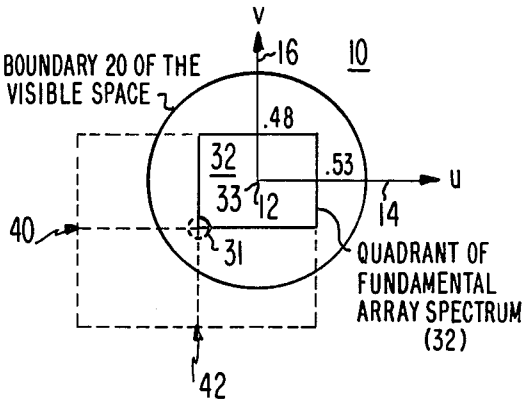
FIG. 5 illustrates the relationship between the boundary of visible space and one quadrant of the fundamental period in FIG. 4 when that quadrant is centered within visible space.

In FIG. 4 the fundamental period 30 of the antenna spectrum 25 has been divided into four quadrants 32, 34, 36 and 38, having centers 33, 35, 37 and 39 respectively. In FIG. 5 one of the quadrants (32) of the fundamental period 30 of the antenna spectrum is illustrated centered within visible space with its center 33 coincident with the origin 12 of transform space. Quadrant 32 is entirely inside the boundary of visible space when quadrant 32 is centered within visible space. Thus, by positioning individual quadrants of the fundamental period of the antenna spectrum within visible space it is possible to obtain data on each of the four quadrants separately without losing data. This positioning can be achieved by directing the array beam off the broadside axis of the array. The broadside axis is that axis which is perpendicular to the face of a planar array at the center of the array face. The off-broadside axis direction selected for this purpose is in the direction of each quadrant's center in u-v space. Such off-broadside aiming of the beam produces (is equivalent to) a frequency shift in transform space. Thus, this shifts the fundamental period of the antenna spectrum off-center with respect to the coordinate system in transform space. As illustrated in FIGS. 6*a*, 6*b*, 6*c* and 6*d*, each of the quadrants 32, 34, 36 and 38, respectively, can be positioned with its center (33, 35, 37 and 39, respectively) at the origin of the u-v coordinate system so that the quadrant is centered in visible space. In each of these positions, the main beam is within visible space. This is accomplished by aiming the beam in a different direction for each quadrant. These four different directions are axially symmetric with respect to the broadside direction.

At the particular frequency at which in-row element-to-element spacing is 0.94λ and row-to-row vertical spacing is 0.26λ, a beam direction off-broadside of 25.2 degrees in the horizontal (x) direction and 27.9 degrees in the vertical (y) direction (for instance into the first quadrant) centers the diagonally opposite quadrant (the third quadrant) of the fundamental period of the antenna spectrum at the origin of transform space.

Where the near-field measurement grid is 512 vertical grid points by 512 horizontal grid points, the transformation of this grid to the far field will produce a grid of data points which is 512 horizontally by 512 vertically. The data at each of these points is an amplitude and a phase. For the antenna element spacing specified for the antenna 120 and with the grid point spacing specified, the result is that the fundamental period of the antenna spectrum in transform space is 128 grid points by 128 grid points. As a result, each "quadrant" is 65 grid points by 65 grid points or will extend 32 grid points on each side of each axis with one row of points on each axis. Once the data from the four fundamental period quadrants has been obtained by steering the beam into the four x-y quadrants at the above specified angles to the x and y axes these data are merged or compiled to form an entire, composite fundamental period of the antenna spectrum as illustrated in FIG. 4, with each quadrant's data in that composite fundamental period having been obtained from near-field data taken with the beam steered in a different direction. The row of data 40 (FIG. 5) is duplicated in the top and bottom halves of this spectrum and the column of data 42 (FIG. 5) is duplicated in the left and right halves of this spectrum. In order to prevent distortion of the fundamental period of the antenna spectrum during the merging of the quadrant data, either one of the two sets of the row 40 data must be deleted or the two sets of row 40 data must be averaged. The column 42 is also handled in one of these two ways.

In transform space, the element spectrum multiplied by the array spectrum equals the antenna spectrum. For this relationship to be accurate, all of the elements must be identical and the pattern of elements in the array must be periodic with each element physically located in an identical environment (a condition which is only approximately met for those elements near the edge of the array, however, they are a small percentage of the total elements in a large array and this approximation is sufficiently accurate to properly align the array. Since the physical spacing of the elements is accurately known, the periodicity of the antenna spectrum is easily obtained and the fundamental period of the antenna spectrum can be obtained from the transform of near-field measured data. This antenna spectrum is associated with the beam shape in x-y-z space at the measurement frequency. In general, this antenna spectrum will be different at each operating frequency, as will the average element spectrum. Therefore alignment of the antenna at each intended operating frequency is desirable. Once the element spectrum is determined, the array spectrum can be obtained by dividing the antenna spectrum by the element spectrum to yield the array spectrum. The element pattern may be determined in any one of several ways. First, the element pattern may be obtained by terminating all elements of the array except one element and measuring far-field data for that element. A second and preferable technique where near-field data is being utilized for the antenna spectrum is to steer the beam to each point in a fundamental period of the array spectrum and measure the response of the antenna at that point. The variation of the response as a function of beam steering combined with knowledge of the overall gain and the nominal efficiency of the antenna are then used to derive the element gain and from that to derive the average element pattern. The (measured, composite) fundamental period of the antenna spectrum may then be divided by the measured average element spectrum to provide the array spectrum. The phase of this spectrum is then corrected to move its reference point from the center of the near-field measurement plane to the center of the array aperture. This spectrum is then inverse Fourier transformed to obtain the individual array element amplitude and phase excitations.

While the fundamental period 30 illustrated in FIG. 4 is a fundamental period of the antenna spectrum for the array element pattern 100, a direct inverse transformation of that fundamental period would not produce the triangular grid of the pattern 100 but rather would produce a rectangular grid. This is because the inverse transformation would treat the fundamental period 30 as a portion of a far-field pattern as illustrated in FIG. 7A in which successive fundamental periods of the array are stacked in checkerboard fashion. Such an inverse transform is appropriate for an antenna which has a rectangular element pattern. In order to force the inverse transform to produce the triangular grid pattern 100 of FIG. 1, fundamental periods 30 are stacked in the brick wall pattern of FIG. 7B and the pattern which is inverse transformed contains eight quadrants as outlined by the bold face line 30' rather than only containing four quadrants. This inverse transformation for the element grid and measurement grid discussed above provides data points at the center of each antenna element. This data is an amplitude and a phase. All elements of a planar array should be at zero phase, since the fundamental period which was inverse transformed is that of a broadside beam. The translation of the quadrants obtained from off-broadside beam steering data back to their position in a broadside beam reverses the frequency shift produced by the phase taper used to steer the beam off-broadside, with the result that the described fundamental period having its center at the u-v origin is a broadside beam fundamental period and inverse transforms as a broadside beam in which all elements have the same phase when the antenna is properly aligned. Thus, any deviation of relative phase from zero is a result of mis-alignment (the failure of an element to set to the desired phase) or of a defective element. If the antenna does not provide controllable relative amplitudes, then substantial amplitude deviation (greater than specifications) from the expected value indicates a need to repair a broken or malfunctioning element. From these individual element excitations a phase correction (and an amplitude correction if amplitude is setable) is determined for each element. These phase corrections will cause that element to be in proper phase with other elements of the antenna, thereby compensating for any element-to-element variations in phase, whether those variations result from the phase shifter for that element or are inherent in the beamformer or other components. These values provide a receive alignment for this antenna since the near-field data was taken with the antenna receiving propagating radiation.

If all elements in the antenna including its phase shifters are reciprocal, then this receive alignment will also serve for transmission alignment. Where non-reciprocal elements are present, transmission alignment can be achieved by connecting a transmitter to the transmit beamformer and using a probe connected to a receiver to measure near-field data or if the non-reciprocity of the elements is known, by calcualtion from the receive alignment data.

In accordance with the present invention, instead of or in addition to changing frequencies during each vertical scan of the probe, the steering direction of the array antenna 120 is changed to collect data in each of the steering directions required for obtaining a composite fundamental period of the array spectrum which is entirely derived from data which was within the visible circle when taken.

This invention has the advantage of allowing even those arrays whose elements are closer together than 0.61λ to be aligned as a complete antenna using near-field data, rather than in sections as is usually done in far-field alignment systems.

Additional information with respect to this method may be found in my article "Phased Array Alignment With Planar Near-Field Scanning Or Determining Element Excitation From Planar Near-Field Data" in *Proceedings of the 1981 Antenna Applications Symposium* Sept. 23, 24, 25, 1981 University of Illinois.

A fundamental period 200 of an array spectrum having a main beam positioned at the center of circle 201 is illustrated in FIG. 8 with respect to the boundary 20 of visible space (in transform space). The fundamental period 200 is too large to allow broadside measurement of the fundamental period of the antenna spectrum but is small enough that four beam directions (as utilized in FIGS. 4 through 7) are not needed. As illustrated in FIG. 9, the fundamental period of this array spectrum may be broken into two halves 210 and 220 (having centers 212 and 222) for measurement purposes and the beam directed off broadside in the direction of the v axis in a manner which is axially symmetric to the u axis to bring first the upper half and then the lower half of the fundamental period of array spectrum within visible space with each half having its center at the origin 12 when it is centered in visible space. In each of these positions the main beam direction is within visible space.

This technique of aiming the beam off-broadside to bring different portions of the antenna spectrum within visible space may be used with any number of beam positions that is necessary to bring the entire fundamental period of the array spectrum within visible space. FIG. 10 illustrates the fundamental period 300 of an array spectrum having a main beam positioned at the center of circle 301. The period 300 is too large in transform space for a full quadrant to fit within the visible space 20 at one time. If fundamental period 300 is divided into nine separate sections 311–319 having centers 321–329, respectively, as shown, then each section may be separately brought entirely within visible space. The center 325 of the central section 315 is also the center of the fundamental period of the array spectrum. This requires aiming the beam in nine different directions. One of these nine directions is the broadside direction which brings the central section 315 of the fundamental period within the visible space. The other eight directions place the main beam in invisible space since the main beam direction 301 will be outside the visible circle. Since the main beam is outside of visible space in this circumstance, no main beam response will be measured. This may produce measurement difficulties with some types of feed networks.

What is claimed is:

1. A method comprising the steps of:

(a) selecting a set of at least first and second off-broadside beam directions for taking near-field data on a phased array antenna which is capable of steering its beam in multiple directions relative to the broadside direction of its array face;

(b) steering said antenna beam in said first direction and taking near-field amplitude and phase data at a selected RF frequency along a measurement grid;

(c) steering said antenna beam in said second direction and taking near-field amplitude and phase data at said selected RF frequency along said measurement grid;

(d) transforming to the far field said near-field data taken with said beam steered in said first direction to provide a set of first direction far-field data points;

(e) transforming to the far field said near-field data taken with said beam steering in said second direction to provide a set of second direction far-field data points;

(f) selecting a subset of said first direction far-field data points all of which are within visible space and a subset to said second direction far-field data points all of which are within visible space; and (g) combining said subsets to represent a complete fundamental period of the array spectrum comprised of some first direction data points and some second direction data points each of which is within visible space in the far-field data set from which it is taken.

2. The method recited in claim 1 further comprising the steps of:

(h) transforming said fundamental period of said array spectrum back to the aperture plane to provide actual amplitude and phase data for each array element; and (i) determining alignment phase corrections for said selected RF frequency by comparing the actual element phase data from step (h) with the excitation phase which produces a broadside beam in that array.

3. The method recited in claim 1 wherein said set of directions includes at least first, second, third and fourth directions and said method further comprises performing prior to step (g) the steps of:

(j) steering said beam in said third direction and taking third direction near-field amplitude and phase data at said selected RF frequency along said measurement plane;

(k) steering said beam in said fourth direction and taking fourth direction near-field amplitude and phase data at said selected RF frequency along said measurement plane;

(l) transforming to the far field said near-field data taken with said beam steered in said third direction to provide a set of third direction far-field data points;

(m) transforming to the far field said near-field data taken with said beam steered in said fourth direction to provide a set of fourth direction far-field data points;

(n) selecting a subset of said third direction far-field data points all of which are within visible space and a subset of said fourth direction far-field data points all of which are within visible space; and wherein step (g) comprises merging said subsets of said first, second, third and fourth direction far-field data.

4. The method recited in claim 1 wherein said near field data is taken with a scanning field probe and the steps b and c are performed repeatedly in an alternate manner while said probe is scanning to obtain near-field data in each of said directions in an interleaved manner during a single scan of said near field.

5. The method recited in claim 3 wherein said near field data is taken with a scanning field probe and the steps b, c, j and k are performed repeatedly in an interleaved manner while said probe is scanning to obtain near-field data in each of said directions in an interleaved manner during a single scan of said near field.

6. The method recited in claim 1 or claim 3 wherein the members of said set of beam directions are distributed in an axially symmetric manner with respect to the broadside direction of said array.

7. The method recited in claim 6 wherein said set includes the broadside direction of said array.

8. The method recited in claim 2 wherein said antenna includes individual array elements whose center-to-center spacing is less than 0.61 wavelengths at said selected frequency and said step (h) provides amplitude and phase data for said individual array elements whose center-to-center spacing is less than 0.61 wavelengths.

9. The method recited in claim 1 further comprising the steps of:

(h) transforming said fundamental period of said array spectrum back to the aperture plane to provide actual amplitude and phase data for each array element; and (i) determining alignment phase and amplitude corrections for said selected RF frequency by comparing the actual element amplitude and phase data from step (h) with the excitation amplitude and phase which produces a broadside beam in that array.

10. In a method of aligning a phased array antenna which is capable of steering its beam in multiple directions relative to the broadside direction of the array face in which (1) near-field data is taken, (2) that near field data is transformed to a far-field spectrum (3) that far-field spectrum is transformed to the aperture of the antenna to determine element excitations and (4) that antenna is aligned on the basis of those determined element excitations, the improvement comprising the steps of:

(a) selecting a set of at least first and second off-broadside beam directions for taking said near-field alignment data;

(b) steering said beam in said first direction and taking near-field amplitude and phase data at said selected RF frequency along a measurement surface;

(c) steering said beam in said second direction and taking near-field amplitude and phase data at said selected RF frequency along said measurement surface;

(d) transforming to the far field said near-field data taken with said beam steered in said first direction to provide a set of first direction far-field data points;

(e) transforming to the far field said near-field data taken with said beam steered in said second direction to provide a set of second direction far-field data points;

(f) selecting a subset of said first direction far-field data points all of which are within visible space and a subset of said second direction far-field data points all of which are within visible space; and (g) combining said subsets to represent a complete fundamental period of the array spectrum comprised of some first direction data points and some second direction data points each of which is within visible space in the far-field data set from which it is taken.

* * * * *